United States Patent [19]

Zenz et al.

[11] 4,172,667

[45] Oct. 30, 1979

[54] METHOD AND APPARATUS FOR BLENDING POWDERS IN A FLUIDIZED BED

[75] Inventors: Frederick A. Zenz, Garrison, N.Y.; Benjamin F. Etheredge, Wilmington, both of N.C.

[73] Assignee: General Electric Company, San Jose, Calif.

[21] Appl. No.: 803,726

[22] Filed: Jun. 6, 1977

[51] Int. Cl.[2] ..... B01F 13/02

[52] U.S. Cl. ..... 366/107; 423/261; 423/DIG. 16

[58] Field of Search ..... 366/101, 107, 106, 102, 366/103, 104; 423/261, DIG. 16; 34/10; 222/195, 193

[56] References Cited

U.S. PATENT DOCUMENTS

| | | | |
|---|---|---|---|
| 2,786,280 | 3/1957 | Gishler | 366/101 |
| 3,807,705 | 4/1974 | Humkey | 366/101 |
| 3,825,230 | 7/1974 | Frye | 366/104 |
| 3,881,702 | 5/1975 | McIver | 366/107 |

OTHER PUBLICATIONS

Page 56 of Bulletin #123, Utah, Engineering Experiment Station, Sixth Printing, Mar. 1970.

*Primary Examiner*—Robert W. Jenkins
*Attorney, Agent, or Firm*—Ivor J. James, Jr.; Samuel E. Turner; Sam E. Laub

[57] ABSTRACT

A mixture of powders, preferably $UO_2$ powders, is blended to complete homogeneity in a nuclear-safe, bubbling-bed fluidized bed blender. The blender includes a generally vertically-oriented, slab-shaped, nuclear-safe mixing vessel having a fluidizing grid disposed on the bottom of the vessel. The fluidizing grid comprises a linear array of generally downwardly-directed pyramidal-shaped hoppers each having walls converging into a conically-shaped closable opening. A plurality of gas orifices is provided for directing a flow of fluidizing gas downwardly into the bottom of each of the hoppers and fluidizing gas is supplied to the orifices at a velocity sufficient to cause bubbles of fluidizing gas to rise through and emerge from the mixture of $UO_2$ powders until a homogeneous blend of solid $UO_2$ powders is achieved. The apparatus eliminates dead-zones normally present near the bottom of prior art fluidized bed blenders. A method is also disclosed of blending a mixture of powders which in a preferred application is a mixture of $UO_2$ powders.

20 Claims, 7 Drawing Figures

METHOD AND APPARATUS FOR BLENDING POWDERS IN A FLUIDIZED BED

BACKGROUND OF THE INVENTION

1. Field of the Invention

The invention relates to the blending of particulate solids and in particular to a method and apparatus for converting a heterogeneous mixture of solid $UO_2$ powders to a homogeneous mixture.

2. Description of the Prior Art

The blending of particulate solids has been accomplished in the past in a variety of ways. Mechanical mixers of several types, such as tumble mixers, ribbon blenders and high shear mixers have been used. Spouting bed blenders and fluidized bed blenders have also been employed. In the prior art, $UO_2$ powders have primarily been blended with mechanical tumble-type blenders such as disclosed in U.S. Pat. No. 3,825,230 to Frye et al. This blender has frequently failed to produce blended batches meeting $UO_2$ powder homogeneity specifications. Failure to meet homogeneity specifications is thought to occur because of stagnant or deadzones within the blender and segregation problems during discharging.

Furthermore, at least a thirty minute blending cycle is required with this type of blender. The length and the nature of the mechanical blending process causes the grinding of the powder into smaller particle sizes which is a great disadvantage in later manufacturing steps when the powder is pressed into $UO_2$ fuel pellets. The physical layout of the mechanical tumble blender also limits the charging and discharging flow rates. In addition to these blending problems large mechanical tumble blenders present a physical safety hazard due to the large rotating mixing chamber, which in practice is generally about six feet in diameter.

Of the two major types of blenders presently in use in which a mixing gas is employed, spouting bed blenders such as the one shown in U.S. Pat. No. 2,786,280 to Gishler et al have not been adopted for the blending of $UO_2$ powders. This is due to the violent action of gas jets penetrating and spouting from the top of the bed causing an excessive loss of $UO_2$ powder through entrainment with the fluidizing gas.

The other major type of prior art blender, the bubbling-bed fluidized bed blenders, having a simple planar array of either upwardly or downwardly directed fluidizing orifices, have also been unable to meet product homogeneity specifications. This is due to stagnant or deadzones that exist at the bottom of the fluidized bed between the gas orifices. A discussion of the design considerations involved in designing a prior art bubbling-bed fluidized bed blender of this type, including a consideration of particle properties, particle size distribution, vessel geometry, superficial gas velocity and circulation patterns, is found in "Fluidization and Particle Fluid Systems" by Frederick A. Zenz and Donald F. Othmer, Reinhold Chemical Engineering Series, Reinhold Publishing Corporation, New York, 1960. Design considerations for possible grid designs may be found in "Fluidization" by J. F. Davidson and D. Harrison, Academic Press, London, 1971.

Referring to FIGS. 1 and 2 the operation of a prior art bubbling-bed fluidized bed blender having either downwardly and upwardly directed fluidizing orifices, respectively, is illustrated. Both the blenders of FIG. 1 and FIG. 2 have a flat or gently sloped bottom wall 1 with a drain 2 disposed at the base of side wall 3. In the case of FIG. 1, a planar array of downwardly directed fluidizing gas orifices 4 is provided and in the case of FIG. 2 a planar array of upwardly directed fluidizing gas orifices 5 is provided. In both cases the orifices supply fluidizing gas at a velocity sufficient to cause bubbles of fluidizing gas to rise through the particulate matter contained in the blender in a manner well-known in the prior art. Circulatory patterns created in the particles of the bed by those rising bubbles are illustrated by the arrows 6. The problem with prior art bubbling-bed fluidized bed blenders presented in these Figures is that shaded stagnant or deadzones 7 are created on the bottom wall 1 between the orifices 4 in FIG. 1 and between the orifices 5 in FIG. 2. These deadzones make it difficult for prior art bubbling-bed fluidized bed blenders to meet product homogeneity specifications for the blending of $UO_2$ powder and make it difficult to completely drain the bed of the blender after the blending process has been completed.

SUMMARY OF THE INVENTION

It is the principal object of the present invention to provide a bubbling-bed fluidized bed blender that solves the many problems attendant upon the use of prior art mechanical and fluidized bed blenders used in the blending of powders.

More specifically, it is an object of the present invention to provide a bubbling-bed fluidized bed blender for blending $UO_2$ powders that eliminates the deadzones previously encountered in bubbling-bed fluidized bed blenders.

These and other objects of the invention are carried out by providing an apparatus for containing the heterogeneous powders, preferably $UO_2$ powders, to be blended comprising a vertically-oriented, slab-shaped, nuclear-safe mixing vessel having a fluidizing grid disposed at the bottom of the vessel. The fluidizing grid constructed according to the invention comprises a linear array of generally downwardly-directed pyramidal-shaped hoppers each having walls converging into a conically-shaped opening. A plurality of gas orifices are provided for directing a flow of fluidizing gas downwardly into the bottom of each of the hoppers. Fluidizing gas is supplied to each of the orifices at a velocity sufficient to cause bubbles of fluidizing gas to rise through the mixture of powders and emerge from the powders until a homogeneous blend of powders is achieved. The combination of the linear array of hoppers and the downwardly directed gas orifices eliminates the deadzones encountered with previous bubbling-bed fluidized bed blender designs. Near perfect product homogeneity is achieved with the blenders of the present invention in about five minutes of blending. The grinding of the powder into smaller particle sizes during blending is minimized and the amount of powder entrained in the fluidizing gas is also minimized. Since the bed of the blender of this invention is static, the hazards associated with other blenders, such as the large rotating mechanical tumble-type blender, are eliminated.

The blender further includes a plurality of valves, one such valve being disposed at the opening of each of the hoppers. These valves serve as outlets for the mixing vessel once a homogeneous blend of powders is achieved. When the blending process is finished the blended powder is rapidly and efficiently discharged by reducing the fluidizing gas velocity to a velocity just sufficient to maintain fluidization of the powder but insufficient to cause bubbles to rise through the powder and the valves are opened to dump the bed of the blender from the hoppers into transport containers disposed below the mixing vessel.

DESCRIPTION OF THE PREFERRED EMBODIMENTS

Figure 1:
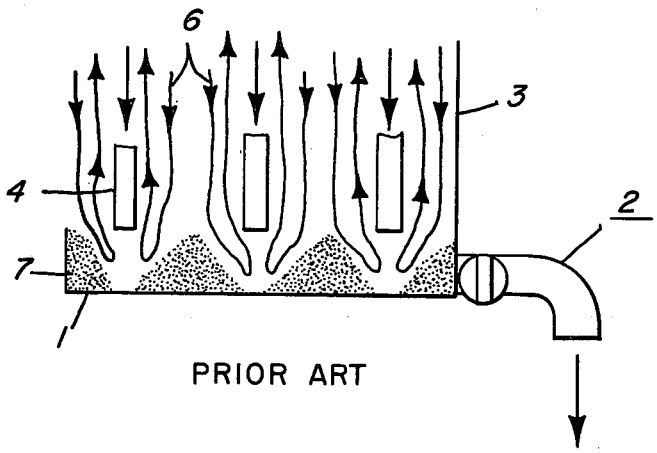
FIG. 1 is a vertical section, in schematic form, of a prior art bubbling-bed fluidized bed blender having downwardly directed fluidizing gas orifices.
Figure 2:
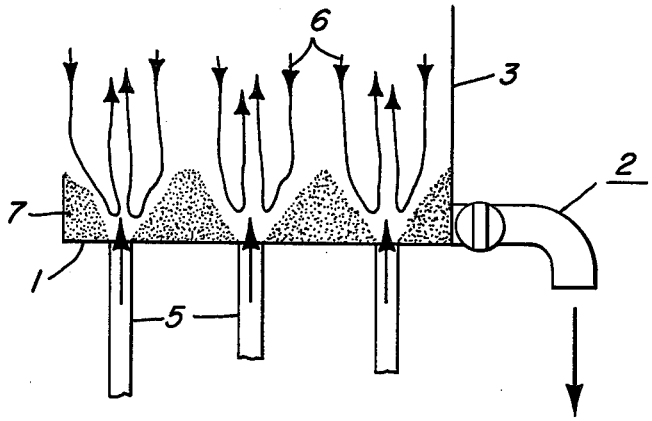
PRIOR ART Fig. 2
FIG. 2 is a vertical section, in schematic form, of a prior art bubbling bed fluidized bed blender having upwardly directed fluidizing gas orifices.
Figure 3:
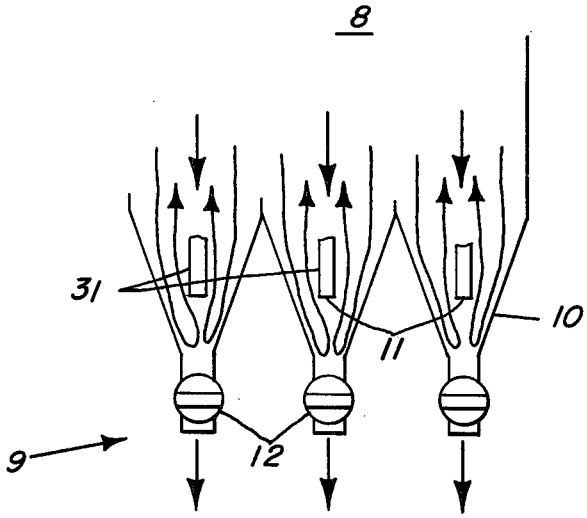
PRIOR ART Fig. 3
FIG. 3 is a vertical section, in schematic form, of bubbling-bed fluidized bed blender of the present invention.

FIG. 3 schematically illustrates the cross section of a bubbling-bed fluidized bed blender that eliminates deadzones by utilizing the method and apparatus of this invention. The apparatus includes a fluidizing grid 9 comprising a linear array of generally downwardly-directed pyramidal-shaped hoppers 10 each having walls converging into a conically-shaped closable opening. A plurality of gas orifices 11 at the end of blowpipes 31 are provided, each directing the flow of fluidizing gas downwardly into the bottom of the adjacent hopper disposed beneath the orifice. Fluidizing gas, which is normally dry nitrogen or dry air at ambient temperature, is passed through the orifices at a velocity sufficient to cause bubbles of fluidizing gas to rise throughout the bed of powders and emerge from the top of the powders until a homogeneous blend of the powders is achieved. The hoppers 10 are shaped to correspond generally with the outline of the deadzones encountered in prior art bubbling-bed blenders described above in the Background of the Invention with reference to FIGS. 1 and 2 so that deadzones are substantially eliminated. A plurality of valves 12 are provided, one such valve being disposed at the opening of each hopper 10, so that the particles in each hopper may be effectively drained, leaving no portion of the batch in the blender at the end of blending.

Blending of the particles in this type of blender is effected as bubbles of gas form from the gas streams 13 emerging from the orifices 11 and rise to the surface of the particle bed in wide sweeping zigzag motions. Once a bubble is formed, adjacent powder particles flow around the upper portion of the bubble and down to its lower portion as the bubble moves upward. Particles lying directly above the bubbles are forced upward and others are pushed aside; some of the latter particles flow down into the lower portion of the bubble, filling its path. Thus a rising bubble spreads particles radially in all directions. As a given bubble rises, particles filling its bottom cavity are packed slightly more tightly than particles immediately outside the bubble's path. The next bubble rising in that area will follow a path through the less tightly-packed particles just to the side of the first bubble's path. Thus, each successive bubble will tend to rise in a different location in the bed, blending different areas of particles with the other areas of particles previously blended. As more and more bubbles rise throughout the bed, small adjacent bubbles join together forming larger ones. This action, along with the bubbles flowing toward low pressure areas, causes a wide sweeping zigzag bubble motion, creating horizontal as well as vertical convective blending currents.

Normally, the vessel 8 is filled to only approximately half its height so that the bottom half of the vessel serves as a mixing chamber and the top half of the vessel serves as a gas plenum. Bubbles burst through the top of the particle bed, scattering some $UO_2$ powder over the gas plenum at the top of the mixing chamber. The compressed gas escapes from the particle bed in puffs rather than in a continuous flow. These intermittent puffs of gas allow some portion of the particles that would be entrained in the gas flow an opportunity to fall back into the particle bed rather than being entrained and swept out with the fluidizing gas. In the bubbling-bed fluidized bed blender herein described, although there are the aforementioned circulatory blending currents, there is really no mass movement of the particle bed such as that occurring in a spouting-bed fluidized bed blender.

Near perfect homogeneity of the $UO_2$ powder can be achieved with the present invention with an upward superficial gas velocity of nitrogen of about 1.25 to about 1.5 feet per second with a blending time of approximately about 5.5 minutes. Superficial gas velocity is a calculated gas velocity determined by dividing the gas flow by the cross-sectional area neglecting the decrease in cross-section in the mixing chamber due to the presence of the $UO_2$ powders.

A typical blending operation consists of a half minute of blending at a superficial gas velocity of 1.5 feet per second, followed by a five minute blending period with a superficial gas velocity of 1.25 feet per second. Once a homogeneous blend of $UO_2$ powders is achieved the fluidizing gas velocity is reduced to velocity at or just above the incipient velocity. The incipient velocity is the superficial velocity of the fluid which, when passing through the interstices, encounters a frictional resistance equal to the weight of the bed of powder, but is insufficient to cause bubbles to rise through the powder. Valves 12 disposed at the bottom of each of the hoppers are opened to discharge rapidly and efficiently the fluidized bed into transport containers disposed below each of the hoppers.

Figure 4:
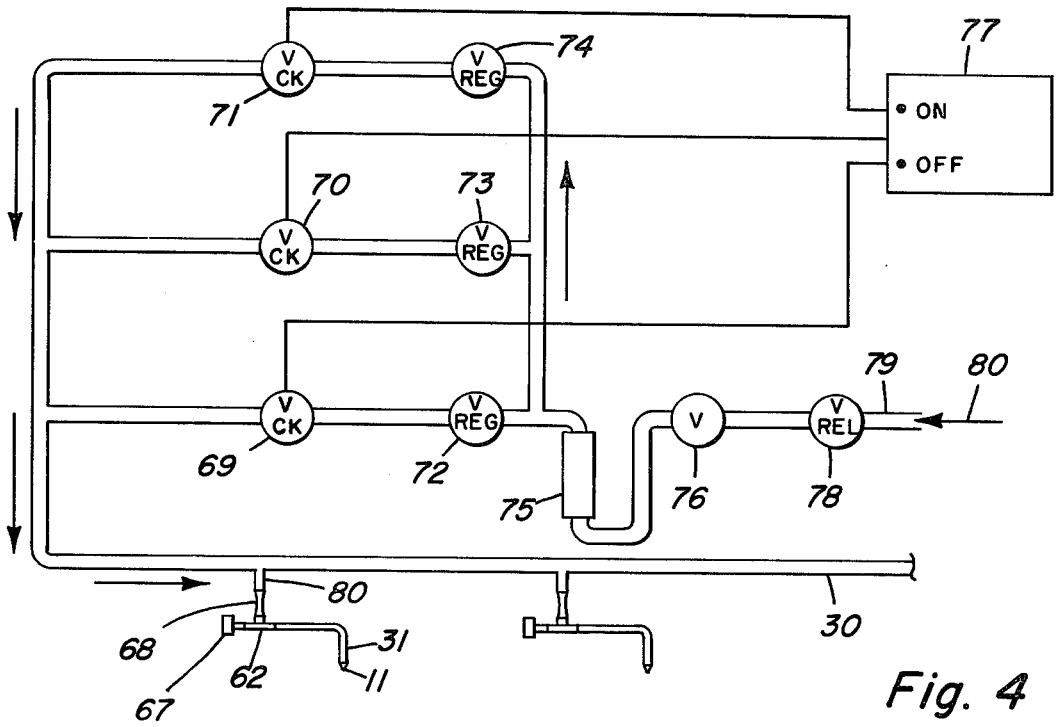
FIG. 4 is a schematic diagram of a fluidizing gas control system regulating the fluidizing gas fed to the orifices of the blender of this invention.

The velocity of the gas for each of the three foregoing process steps is controlled by a network of ball valves, pressure regulating valves and a sequence time as illustrated in FIG. 4. Upon initiating the process, the sequence timer (controller) 77 sends a signal to the normally closed ball valve 69 causing valve 69 to open admitting fluidizing gas from fluidizing gas source 80 into fluidizing gas supply line 79 to the main manifold 30 at a superficial fluidization velocity of about 1.5 feet/-second. Valve 69 receives this signal for about thirty seconds. Pressure reducing regulator 72 regulates the superficial fluidization velocity of the fluidizing gas to 1.5 feet/second. The fluidizing gas flow rate is monitored by rotometer 75 and safety valve 78 is used as a safety valve to bleed excess gas pressure from fluidizing gas supply line 79 while valve 76 serves as a main pressure regulator. After the thirty second period, the timer 77 advances closing valve 69 and sending a signal to normally closed ball valve 70 opening this valve to admit fluidizing gas to the main manifold 30 at a superficial fluidization velocity of about 1.25 feet/second for about five minutes. Pressure reducing regulator 73 regulates the superficial fluidization velocity of the fluidizing gas to 1.25 feet/second. After about five minutes, the timer 77 advances closing valve 70 and opening valve 71 to admit fluidizing gas at a rate sufficient to cause incipient fluidization as controlled by pressure reducing regulator 74 (i.e., at a rate in the range of about 0.2 to 0.3 feet/second). This continues until the blender is discharged and the system is turned off by manually pushing the off button on timer 77. To maintain uniform distribution of the fluidizing gas to each of the orifices 11, a choke 68 is installed in each pipe 80 leading from manifold 30 to "T" connection 62 with blow pipe 31. Clean-out caps 67 close off each blow pipe 31.

Figure 5:
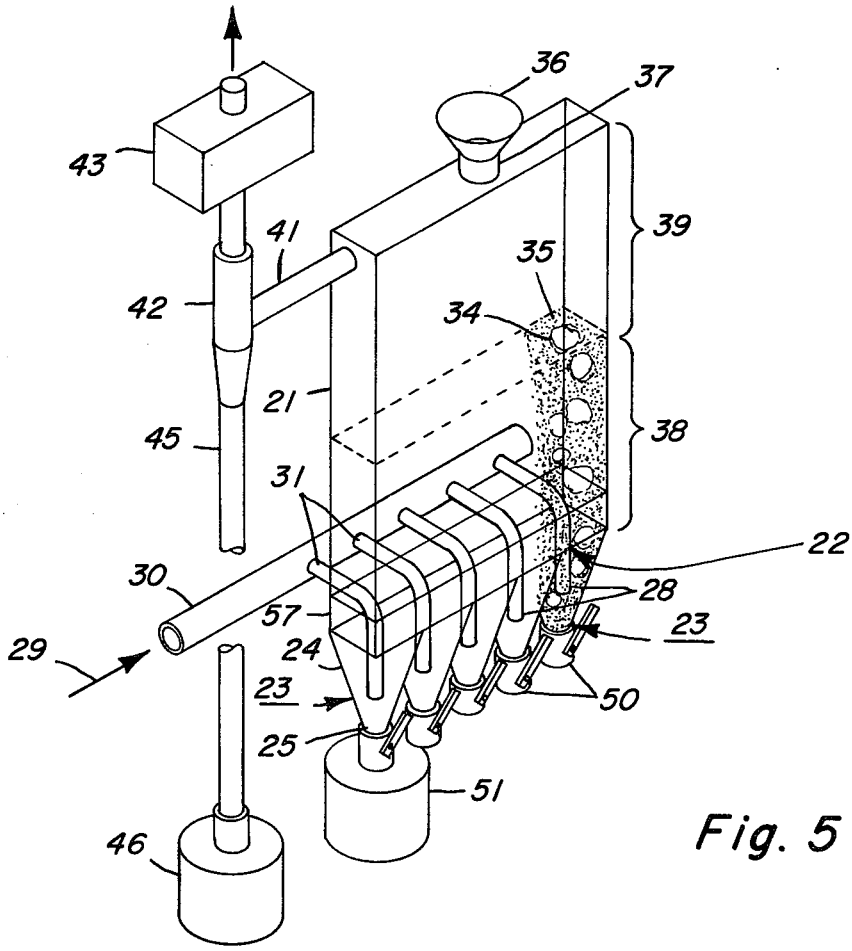
FIG. 5 is a perspective illustration of a bubbling-bed fluidized bed blender constructed according to the present invention.

Referring now to FIG. 5, one detailed embodiment of a bubbling-bed fluidized bed blender constructed according to the present invention is illustrated. The blender is comprised of a vertically-oriented, rectangular slab-shaped, nuclear-safe mixing vessel 21 having a fluidizing grid 22 disposed on the bottom of the vessel 21. The fluidizing grid 22 is comprised of a linear array of generally downwardly-directed pyramidal-shaped hoppers 23 each having walls 24 converging into a conically-shaped opening (apex) 25. A plurality of gas orifices 28 are provided for directing a flow of fluidizing gas downwardly into the bottom of each hopper 23. A source of fluidizing gas at 29 is connected to each of the orifices 28 by a common manifold 30 and a plurality of blowpipes 31 which supply fluidizing gas at a velocity sufficient to cause bubbles 34 to rise through a mixture of powders 35, preferably a mixture of $UO_2$ powders, contained in the vessel 21. The vessel 21 of the fluidized bed blender is filled through inlet 36 having a valve such as a butterfly valve indicated generally at 37 associated therewith for preventing the escape of powders during the blending process. The valve 37 is not shown in detail since it is not part of the present invention and any suitable type of valve may be employed. The vessel 21 has a height approximately twice that of the $UO_2$ powders normally processed therein so that the vessel is initially filled to approximately half of its height with heterogeneous or unblended powders. Thus, the bottom half 38 of the vessel 21 serves as a mixing chamber for the vessel while the top half 39 serves as a gas plenum where $UO_2$ powders entrained in the fluidizing gas separate from the gas and fall to the bed in the bottom half 38.

The fluidized bed blender of the present invention includes an off-gas system comprising a fluidizing gas outlet 41 disposed at the top of the vessel 21, a cyclone separator 42 connected to receive fluidizing gas from the fluidizing gas outlet and a high efficiency filter 43 connected to receive fluidizing gas from the cyclone separator 42. Gas discharged from the high efficiency filter 43 is eventually routed to the factory exhaust system. Solids separated out of the cyclone separator 42 fall through the pipe 45 into a container 46 disposed below the cyclone separator 42. The off-gas system is not part of this invention and is indicated only generally in the drawing. Any suitable conventional off-gas system may be employed.

The fluidized bed blender further includes a plurality of valves 50, one of which is disposed at the opening 25 of each of the hoppers 23. The valves 50 serve as outlets or drains for blended powders. Once a homogeneous blend of powders is achieved the flow of fluidizing gas is reduced to a velocity at or just above incipient rate, that is just sufficient to maintain fluidization of the $UO_2$ powders but insufficient to cause bubbles to rise through the powders, and the valves are opened allowing the contents of the fluidized bed to rapidly discharge to a plurality of containers, one of which is depicted at 51, disposed directly below the hoppers 23.

Figure 6:
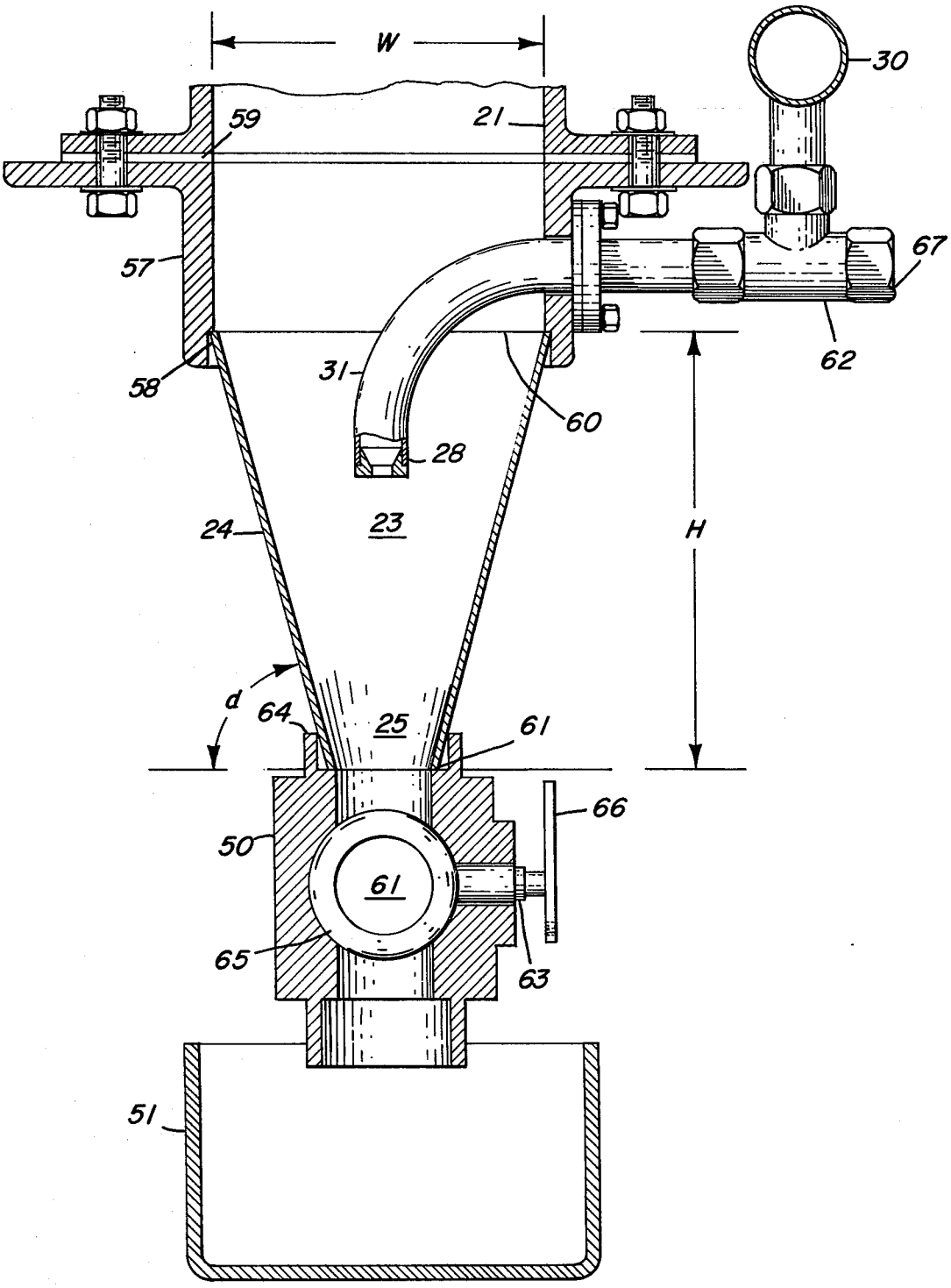
FIG. 6 is a side view in vertical section of one of the hoppers and downwardly directed gas orifices comprising a fluidization grid of the present invention.
Figure 7:
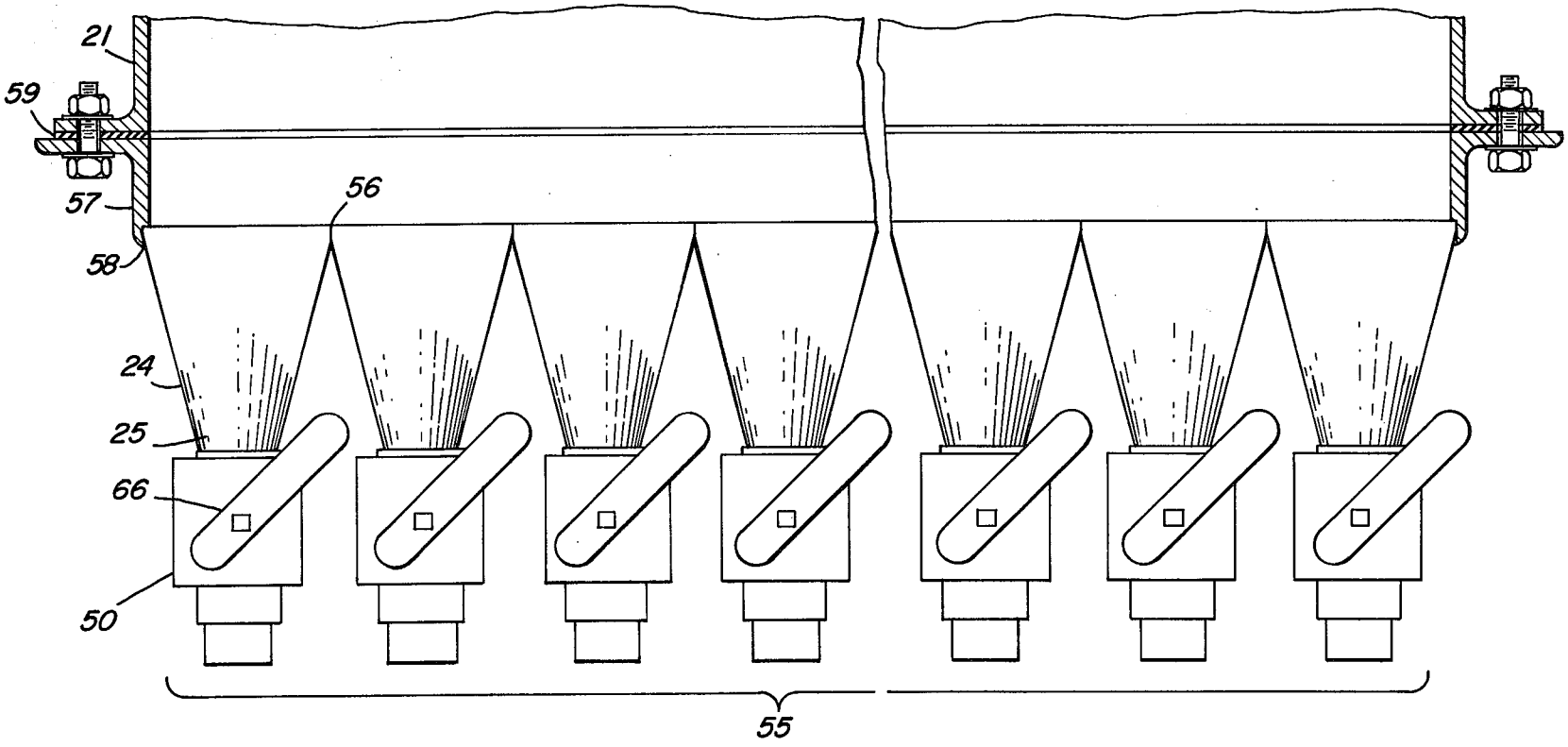
FIG. 7 is a front view of a fluidization grid constructed according to the present invention.

Referring now to FIGS. 6 and 7 when the powders being blended are $UO_2$, more details of the fluidizing grid of the present invention are illustrated. The hoppers 23 are welded at 56 in a linear array 55 and the array 55 is welded to a transition piece 57 at 58. The transition piece 57 is of L-shaped cross-section and forms a central opening corresponding in size to the tops of the array of hoppers 23. The transition piece 57 thus surrounds the array of hoppers at the tops thereof and is welded thereto at 58. The transition piece 57 is bolted to the bottom of the mixing vessel 21 with a suitable gasket material 59 disposed therebetween. To insure a nuclear-safe vessel for blending $UO_2$ powder enriched with the U-235 isotope in amounts from about 0.7% up to 4.0% by weight, the vessel 21 has a maximum width W of about five inches and the hoppers are arranged in a single linear array. In one embodiment of this invention the central opening of the transition piece 57 also has a width of about five inches and the top of each pyramidal-shaped hopper 23 is about a five-inch square section 60. Each hopper 23 then gradually tapers from the five inch square section at 60 to a 1.5 inch diameter round section 61 at the bottom of the hopper. In one specific embodiment the height H of the hoppers 23 is about 6.531 inches and the walls 24 of the hoppers 23 form an angle $\alpha$ that is 75° with respect to the horizontal.

The orifices 28 are disposed at the end of elbow-shaped blowpipes 31 which direct a gas jet from each of the orifices 28 downwardly into the opening 25 of the corresponding hopper 23. The blowpipes 31 are bolted to the transition piece 57 and to manifold 30 so that different blowpipes having different orifice sizes may be substituted, if desired. As shown in the detailed representation in FIG. 6 a T-connection 62 may be provided for each of the blowpipes 31 to effect connection to the manifold 30 and to facilitate substitution of blowpipes having a different orifice size and downward length when desired. One leg of the "T" 62 is fitted with a removable cap 67 to allow clean-out of blow pipe 31 in the event of plugging. The size of the orifice 28 is normally in a range of 5/16 to ⅜ of an inch in diameter. This is sufficient, when dry nitrogen at ambient temperature and 3–4 psi is used as a fluidizing gas, to form bubbles of approximately 2½ inches in diameter in the bed of powder when the vessel 21 contains a 48 inch high column of $UO_2$ powders.

The valves 50 are welded to the bottom of the hoppers 23 at 64. The valves 50 may be of any type having a straight-through bore 61 which eliminates the possibility of powder segregation or plugging during the discharge operation. In a particular embodiment the ball 65 has a full throat diameter of 1.15 inch and the valves are welded to the 1.5 inch diameter opening at the bottom of the hoppers 23. Each valve has stem 63 connected to operating lever 66 which allows the valves to be individually opened for discharging sections of the fluidized bed blender into the containers 51 disposed below each valve.

The blender of this invention is useful for blending powders having an instantaneous flow function of greater than about 4.0 (i.e., 4.0 to ∞) as measured by a Jenike-type flow factor tester. The instantaneous flow function as used herein is the relationship between the unconfined yield strength and the consolidating pressure for the particles of powder being blended. The instantaneous flow function and the flow factor tester are more fully described in Bulletin No. 123, Utah Engineering Experimental Station, *Storage and Flow of Solids* by Andrew W. Jenike.

Other forms, embodiments and applications of the invention may occur to those skilled in the art and it is intended by the appended claims to cover all such modifications coming within the scope of this invention.

What is claimed:

1. A fluidized bed blender suitable for blending a mixture of powders comprising:

(a) a vertically-oriented mixing vessel having a rectangularly shaped cross section;

(b) a fluidizing grid disposed on the bottom of said vessel, said fluidizing grid including;

(i) a linear array of pyramidal-shaped hoppers, each of said hoppers converging to a conically shaped downwardly-directed opening; and (ii) a respective gas orifice in each of said hoppers, each orifice being positioned for directing a flow of fluidizing gas exclusively downwardly toward the opening of its respective hopper, and (c) means connected to said orifices for supplying fluidized gas at a velocity sufficient to cause bubbles of fluidizing gas to rise through said mixture of powders and emerge from the top of said powders to form a homogeneous blend of said powders.

2. A fluidized bed blender of claim 1 wherein said means connected to said orifices includes:

(a) a manifold adapted to be connected to a source of fluidizing gas; and (b) a plurality of blowpipes connected to said manifold and having said orifices disposed at the ends thereof.

3. A fluidized bed blender of claim 2 and further including:

(a) a transition piece mounted on said vessel and having a rectangular opening surrounding the linear array of hoppers at the top thereof;

(b) said blowpipes extending through said transition piece and mounted thereto; and (c) said blowpipes being elbow-shaped so that said orifices at the ends thereof are directed downwardly toward the openings of said hoppers.

4. A fluidized bed blender of claim 1 wherein the powder is comprised of $UO_2$ and further including:

(a) a plurality of valves for discharge of blended powders from said mixing vessel, each of said valves being disposed at the opening of a corresponding one of said hoppers; and (b) means for reducing the gas velocity to a velocity just sufficient to maintain fluidization of said $UO_2$ powder but insufficient to cause bubbles to rise through said $UO_2$ powder before said $UO_2$ powder is discharged through said valves.

5. A fluidized bed blender of claim 4 wherein said valves are ball valves having a straight-through bore.

6. A fluidized bed blender of claim 1 wherein the powder is comprised of $UO_2$, (a) said mixing vessel has a height approximately twice that of said $UO_2$ powder normally processed therein; and (b) the bottom half of said vessel serves as a mixing chamber and the top half of said vessel serves as a gas plenum where the $UO_2$ powder entrained in the fluidizing gas may settle.

7. A fluidized bed blender of claim 1 wherein said means for supplying fluidized gas is adapted to receive dry nitrogen at ambient temperature.

8. A fluidized bed blender of claim 1 further including means for controlling supply of gas to provide a superficial gas velocity in a range between 1.25 and 1.50 feet/second during fluidized bed blending.

9. A fluidized bed blender of claim 1 wherein:

(a) said hoppers are approximately 6.5 inches high and taper from a 5 inch square cross-section at the top to a round cross-section 1.5 inches in diameter at the bottom; and (b) the walls of said hoppers are inclined at an angle of approximately 75° with respect to horizontal.

10. A fluidized blender of claim 1 wherein the powder is comprised of $UO_2$ and said vessel has a nuclear-safe cross section for the blending of said $UO_2$.

11. A method for blending a mixture of powders comprising the steps of:

(a) providing a generally vertically oriented mixing vessel zone including in said zone a linear array of pyramidal-shaped hoppers that each converge to a conically-shaped, downwardly directed opening;

(b) supplying the powders to be blended to said vessel zone in an amount sufficient to partially fill said vessel zone; and (c) exclusively directing fluidizing gas downwardly toward each opening at a velocity sufficient to cause bubbles of said fluidizing gas to rise through said powders and emerge from the top of said powders until a homogeneous blend of said powders is achieved.

12. A method of claim 11 wherein said mixing vessel zone is filled to approximately half of its height with powders, the bottom half of the mixing vessel zone serving as a mixing chamber and the top half of the mixing vessel zone serving as a gas plenum where powders entrained in the fluidizing gas may settle.

13. A method of claim 11 wherein the fluidizing gate is dry nitrogen and is supplied at a superficial gas velocity in the range of about 1.25 to about 1.5 feet per second for about 5.5 minutes.

14. A method of claim 13 wherein the fluidizing gas is supplied at a superficial gas velocity of about 1.5 feet per second for about one-half minute and thereafter supplied at a superficial gas velocity of about 1.25 feet per second for about 5 minutes.

15. A method of claim 13, including the further steps of:

(a) reducing the velocity of the fluidizing gas to or just above the incipient velocity which is sufficient to maintain fluidization of the powders but insufficient to cause gas bubbles to rise through the powders; and (b) thereafter discharging the blended powders from said hoppers.

16. A method of claim 13 in which the velocity of the fluidizing gas at incipient velocity is about 0.2 to 0.3 feet per second.

17. A method of claim 11 in which the powders are comprised of $UO_2$.

18. A method of claim 17 in which the $UO_2$ is enriched with U-235.

19. A method of claim 11 in which the fluidizing gas is comprised of dry air.

20. A method of claim 11 in which the fluidizing gas is comprised of dry nitrogen.

* * * * *